US006581563B2

(12) United States Patent
Uneta

(10) Patent No.: US 6,581,563 B2
(45) Date of Patent: Jun. 24, 2003

(54) METHOD FOR LUBRICATING TWO-CYCLE INTERNAL COMBUSTION ENGINE

(75) Inventor: Hisashi Uneta, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/897,061

(22) Filed: Jul. 3, 2001

(65) Prior Publication Data

US 2002/0011231 A1 Jan. 31, 2002

(30) Foreign Application Priority Data

Jul. 4, 2000 (JP) ..... 2000-202480
Jan. 24, 2001 (JP) ..... 2001-015556

(51) Int. Cl.[7] ..... F01M 1/00
(52) U.S. Cl. ..... 123/196 R
(58) Field of Search ..... 123/196 M, 73 C, 123/73 AD, 196 R, 73 AA, 73 R, 73 A; 184/6.8, 6.5

(56) References Cited

U.S. PATENT DOCUMENTS 5,960,749 A * 10/1999 Isomura et al. ..... 123/73 C
5,983,851 A * 11/1999 Kimijima et al. ..... 123/196 M
6,273,050 B1 * 8/2001 Ko ..... 123/196 R

FOREIGN PATENT DOCUMENTS

JP 10325313 A 8/1998

* cited by examiner

*Primary Examiner*—Noah P. Kamen
*Assistant Examiner*—Hyder Ali
(74) *Attorney, Agent, or Firm*—Birch, Stewart, Kolasch & Birch, LLP

(57) ABSTRACT

An internal combustion engine includes a combustion chamber, a chamber portion, and a communication passage for communicating the combustion chamber to the chamber portion. A valve for opening/closing the passage allows a high compression gas to be charged into the chamber portion and an air-fuel mixture to be injected from the chamber portion into the combustion chamber. A lubricating system keeps the opening of the passage to the combustion chamber and a surface of a piston facing to the opening well lubricated. The lubricating system includes an oil supply hole opening in a same direction as the opening of the passage to the combustion chamber. The oil supply hole may be positioned under the opening of the passage, or may be provided between a lower edge of the opening of the passage and a piston ring of the piston, when the piston is located at a bottom dead center.

21 Claims, 10 Drawing Sheets

(a)

(b)

METHOD FOR LUBRICATING TWO-CYCLE INTERNAL COMBUSTION ENGINE

BACKGROUND OF THE INVENTION

1. Field of the Invention

The present invention relates to a method of lubricating a sliding portion between a cylinder and a piston of a two-cycle internal combustion engine configured to prevent blow-by of an air-fuel mixture in a combustion chamber, thereby enhancing a fuel consumption and an exhaust purifying performance.

2. Description of the Relevant Art

FIGS. 9 and 10 show a prior art two-cycle internal combustion engine disclosed in Japanese Patent Laid-open No. Hei 10-325313. FIG. 9 is a longitudinal sectional view of an essential portion of the engine and FIG. 10 is a horizontal sectional view of an essential portion of the engine.

In the two-cycle internal combustion engine of this type, air is sucked and compressed in a crank chamber and the scavenging is performed by the compressed air; after the scavenging only by air is ended, a high compression gas is charged from a combustion chamber 013 into a chamber portion 020 provided adjacently to a cylinder 005; and an air-fuel mixture is formed by the high compression gas and fuel and is injected into the combustion chamber 013.

In these figures, reference numeral 003 designates a cylinder block; 005 is a cylinder provided in the cylinder block 003; and 020 is a chamber portion provided adjacently to the cylinder 005. The cylinder 005 is connected to the chamber portion 020 via a communication passage 030. A rotary valve 040 for opening/closing the communication passage 003 is provided in a mid portion of the communication passage 030.

The communication passage 030 has one cylinder side passage portion positioned on the cylinder 005 side from the rotary valve 040, and two chamber portion side passage portions positioned on the chamber portion 020 side from the rotary valve 040. In the figures, reference numeral 031 designates a cylinder side opening of the communication passage 030, and reference numeral 032 designates each of two chamber portion side openings of the communication passage 030. A fuel injector (not shown) is mounted in each of two mounting holes 036 formed at ends of intermediate portions of the two chamber portion side passage portions of the communication passage 030.

The rotary valve 040, disposed in such a manner as to cross the communication passage 030, is composed of a first control valve 041 configured as a deeper cutout and a second control valve 042 configured as a shallower cutout. The second valve 042 is disposed in front of the first control valve 041 in the rotational direction while being continuous to the first control valve 041. The first control valve 041 controls the flow of a high compression gas, and the second control valve 042 controls the flow of an air-fuel mixture.

The switching from the flow of an air-fuel mixture to the flow of a high compression gas is dependent on a balancing relationship between a pressure in the combustion chamber 013 and a pressure in the chamber portion 020. This is because the communication passage 030 is commonly used for charging the high compression gas in the chamber portion 020 and for injecting the airfuel mixture from the chamber portion 020. To be more specific, when the pressure in the combustion chamber 013 becomes higher than the pressure in the chamber portion 020, the flow in the communication passage 030 is switched from the flow of the air-fuel mixture into the flow of the high compression gas. Nearly at this time, the flow control by the rotary valve 040 is shifted from the flow control of the air-fuel mixture by the second control valve 042 to the flow control of the high compression gas by the first control valve 041.

In the figures, reference numeral 014 designates each of four scavenging passages, and 021 also designate a scavenging passage; 015 is a cylinder side opening of the scavenging passage 014, and 022 is a cylinder side opening of the scavenging passage 021; 016 is an exhaust passage and 017 is a cylinder side opening of the exhaust passage 016; and 013 is a combustion chamber.

Referring to FIG. 10, two lubricating oil supply holes 050 for lubricating a sliding portion between the cylinder 005 and the piston 006 are provided on both sides of the communication passage 030. Cylinder side openings 051 of both the lubricating oil supply holes 050 are formed in the inner wall surface of the cylinder 005 at positions located on both sides of the cylinder side opening 031 of the communication passage 030 in the circumferential direction and located between the opening 031 of the communication passage 030 and the scavenging openings 015 in the height direction. Lubricating oil, which is fed in the lubricating oil supply holes 050 by an oil pump (not shown) connected to outer openings 052 of the lubricating oil supply holes 050, flows from the openings 051 of the lubricating oil supply holes 050 into the cylinder bore 005.

Two lubricating oil supply holes 055 having openings 056 are provided on both sides of the cylinder side opening 017 of the exhaust passage 016 as needed. Lubricating oil, which is fed in the lubricating oil supply holes 055 by an oil pump (not shown) connected to outer openings 057 of the lubricating oil supply holes 055, flows from the openings 056 of the lubricating oil supply holes 055 into the cylinder bore 005.

In the above-described prior art internal combustion engine, an air-fuel mixture containing gasoline as fuel is injected from the cylinder side opening 031 of the communication passage 030. The gasoline contacts a portion near the opening 031 of the communication passage 30 of the inner all of the cylinder 005, and a portion facing to the opening 031 of the communication passage 030 of the outer peripheral surface of the piston 006. As a result, the lubricating oil adhering on the inner wall of the cylinder 005 and on the outer peripheral surface of the piston 006 is often carried away or washed away by the gasoline. As a result, according to the prior art engine, it is difficult to maintain the lubricating performance, and to prevent lubricating oil adhering particularly on a portion on the communication passage side of the piston 006 from being all carried away by gasoline. Therefore, in accordance with the prior art, it has been necessary to supply an excessive amount of lubricating oil from the lubricating oil supply holes 050.

SUMMARY OF THE INVENTION

It is an object of the present invention is to solve one or more of the drawbacks of the prior art's internal combustion engines. To this end, the present invention provides a lubricating system for a two-cycle internal combustion engine, which is capable of sufficiently and effectively lubricating the engine by supplying a smaller amount of lubricating oil.

According to the present invention, there is provided a method of lubricating a two-cycle internal combustion engine which includes a combustion chamber, a chamber portion, a communication passage provided between the combustion chamber and the chamber portion. One end of the communication passage is opened in an upper portion of a cylinder as a constituent component of the combustion chamber, and a control valve for controlling the opening/closing of the communication passage is provided.

A high compression gas is charged in the chamber portion and an air-fuel mixture is injected from the chamber portion into the combustion chamber via the communication passage by way of the high compression gas stored in the chamber portion.

A lubricating system in accordance with the present invention is characterized as follows:

(1) A lubricating oil supply hole is provided in the cylinder. The lubricating oil supply hole has a cylinder side opening positioned in the same direction as the direction in which a cylinder side opening of the communication passage is positioned, as seen from the center line of the cylinder. With this configuration, since the piston (or the piston ring) passes through the opening of the lubricating oil supply hole immediately before and after it passes the opening of the communication passage in the upward or downward stroke of the piston, even if lubricating oil adhering on the wall surface of the piston (or piston ring) is carried away by fuel, lubricating oil can be immediately, newly supplied thereto.

(2) In addition to the configuration of the lubricating method described in the item (1), the cylinder side opening of the lubricating oil supply hole may be positioned under the cylinder side opening of the communication passage. With this configuration, it is possible to reduce the influence of heat and/or pressure in the combustion chamber exerted on the lubricating oil supply hole in the downward stroke of the piston.

(3) In addition to the configuration of the lubricating method described in the item (1), the cylinder side opening of the lubricating oil supply hole may be provided between the lower edge of the cylinder side opening of the communication passage and a position at which a piston ring of a piston is located when the piston is moved down to the bottom dead center. With this configuration, since lubricating oil can be supplied not only to the wall surface of the piston, but also to the piston ring itself, it is possible to effectively supply lubricating oil to the sliding surface of the sliding portion between the cylinder and the piston.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE INVENTION

Figure 1:
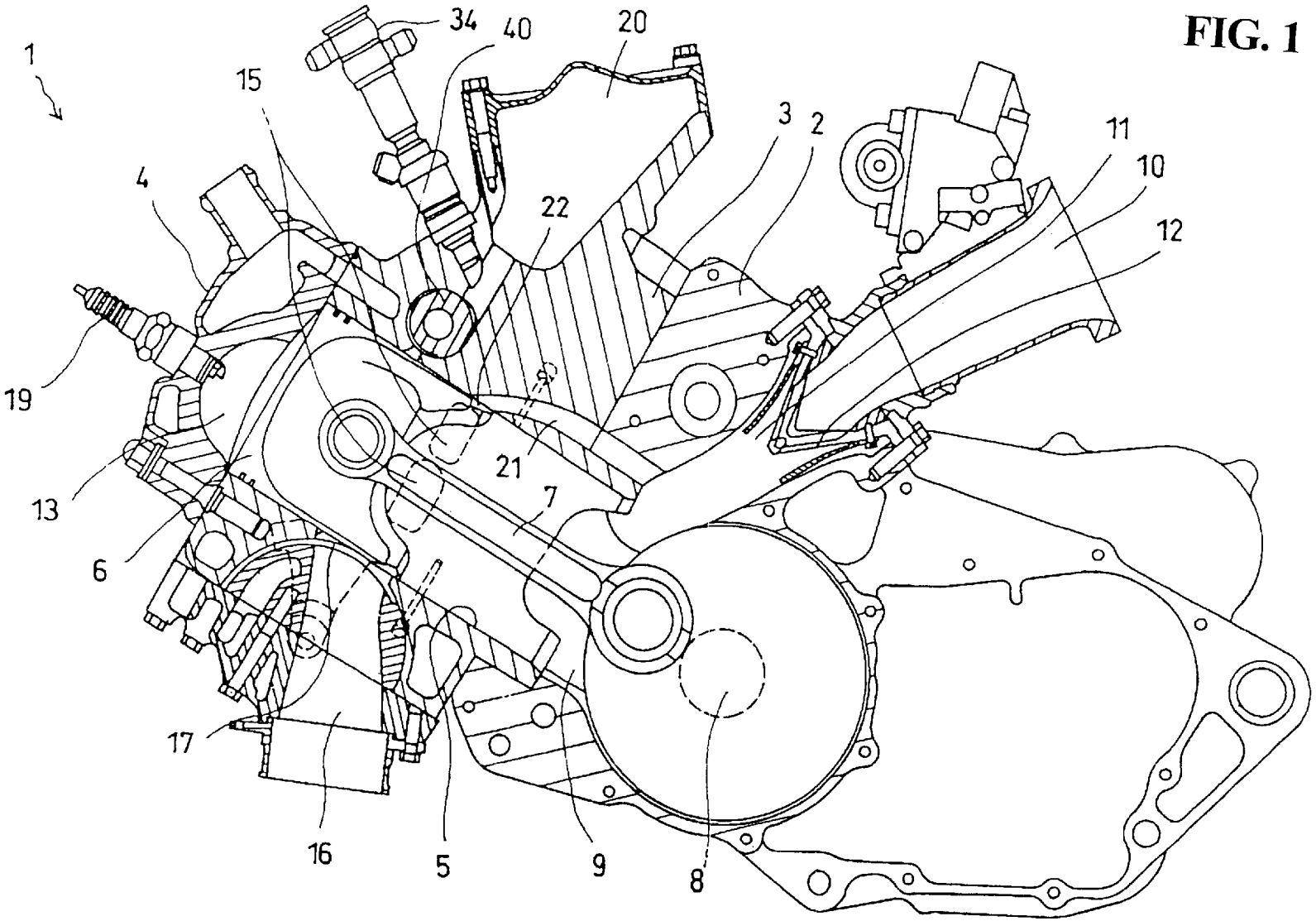
FIG. 1 is a cross sectional side view of a two-cycle internal combustion engine, according to the present invention.

Referring to FIG. 1, a two-cycle internal combustion engine 1 mounted to a motorcycle (not shown) is configured such that a cylinder block 3 and a cylinder head 4 are sequentially stacked on a crankcase 2 and are integrally jointed to each other.

A piston 6 is vertically slidably fitted in a cylinder 5 formed in the cylinder block 3. The piston 6 is connected to a crankshaft 8 via a connecting rod 7, whereby the crankshaft 8 is rotated along with upward/downward movement of the piston 6.

An intake passage 10 extending from the rear side to the front side of the vehicular body is connected to an intake passage 11 of the crankcase 2. A throttle valve (not shown) and a reed valve 12 are interposed in series in the intake passage 11. The throttle valve is connected to a throttle grip (not shown) via a connecting means (not shown). The opening degree of the throttle valve is increased by twisting the throttle grip in one direction.

Figure 3:
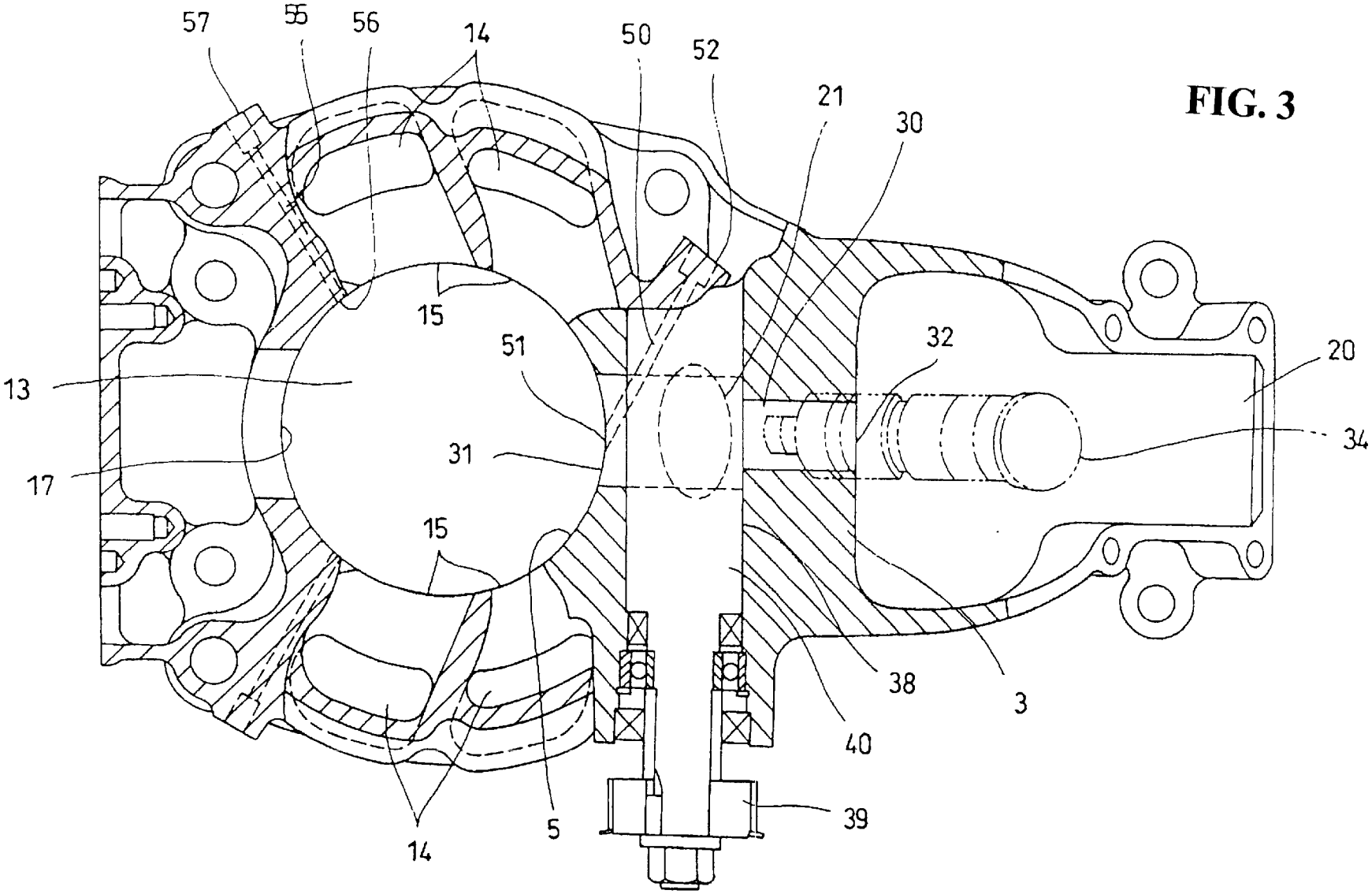
FIG. 3 is a cross sectional overhead view of an important portion of the internal combustion engine shown in FIG. 1.

Referring to FIGS. 1 and 3, five scavenging passages for supplying air are formed in the crankcase 2 and the cylinder block 3: two pairs of right and left scavenging passages 14 for communicating an upper portion of the cylinder 5 and a crank chamber 9, and a rear side scavenging passage 21 for directly communicating the upper portion of the cylinder 5 to a portion, on the downstream side from the reed valve 12, of the intake passage 11 of the crankcase 2. The ends, on the cylinder 5 side, of the scavenging passages 14 and 21 are taken as openings 15 and 22.

Referring to FIG. 1, a cylinder side exhaust opening 17 of an exhaust passage 16 extends to a position higher than the positions of the openings 15 and 22 of the scavenging passages 14 and 21. An approximately semispherical combustion chamber 13 is disposed above the cylinder 5 in such a manner as to be offset to the exhaust opening 17. An ignition plug 19 is mounted to the combustion chamber 13.

Figure 2:
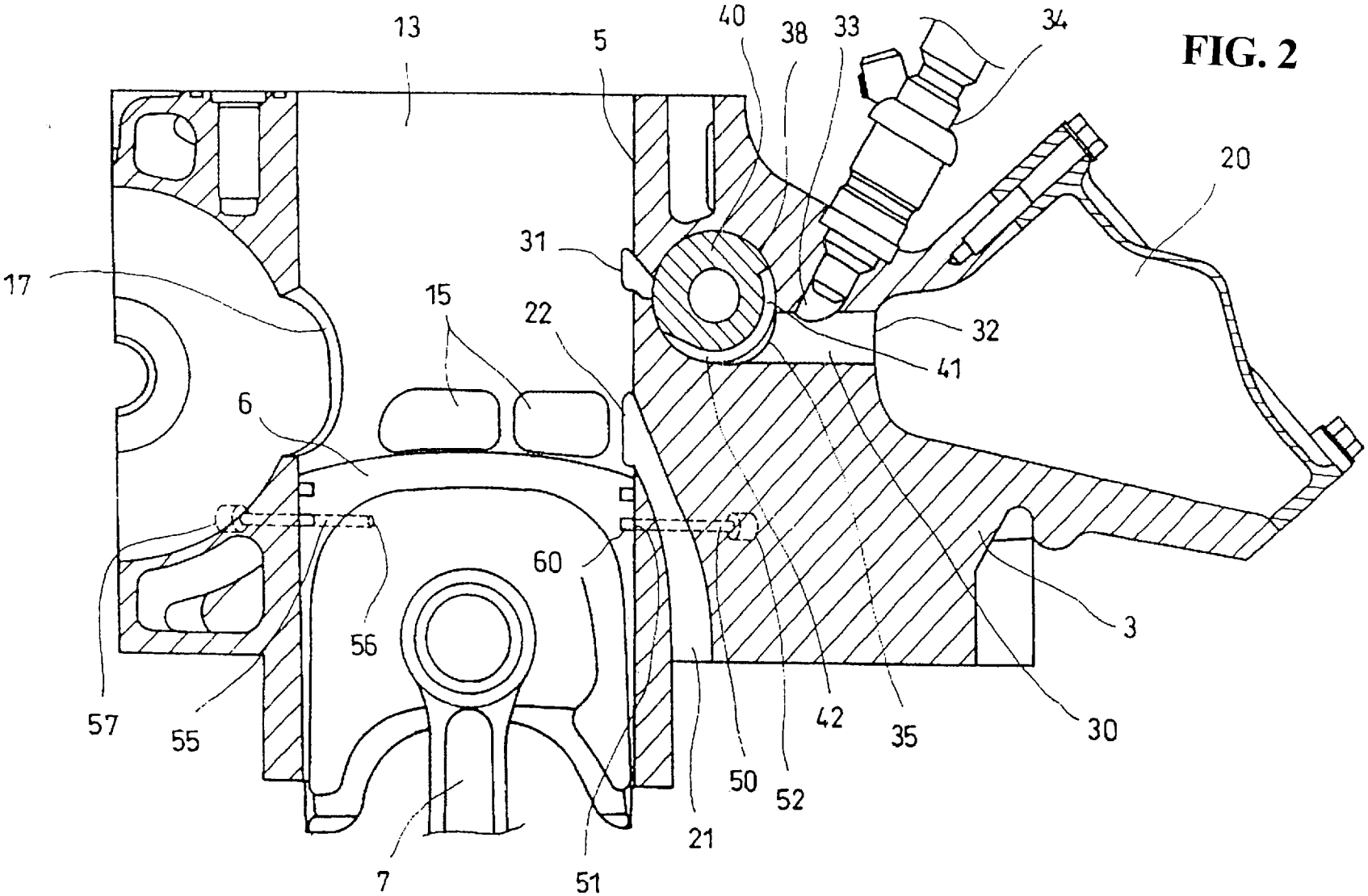
FIG. 2 is a close-up cross sectional side view of an important portion of the internal combustion engine shown in FIG. 1.

Referring to FIG. 2, a chamber portion 20 is provided in a portion, offset to the rear side of the vehicular body, of the cylinder block 3. A communication passage 30 is provided for communicating an upper portion of the cylinder 5 to the chamber portion 20. A valve housing hole 38 is provided in such a manner as to cross a mid portion of the communication passage 30. A rotary valve 40 is rotatably mounted in the valve housing hole 38. The rotary valve 40 is rotated at the same rotational speed as that of the crankshaft 8 in the rotational direction (clockwise in FIG. 1) reversed to the rotational direction of the crankshaft 8 by a transmission mechanism (not shown). In FIG. 3, reference numeral 39 designates a pulley mounted to one end of the rotary valve 40. The transmission mechanism (not shown) is wound around the pulley 39.

The communication passage 30 is commonly used for allowing a high compression gas to flow from the combustion chamber 13 into the chamber portion 20, and for allowing an air-fuel mixture and the high compression gas to flow from the chamber portion 20 into the combustion chamber 13 therethrough. The communication portion 30 is composed of a passage portion opened on the cylinder side and a passage portion opened on the chamber portion side, with a control portion of the rotary valve 40 put therebetween. Reference numeral 31 designates a cylinder side opening of the communication passage 30. Reference numeral 32 is a chamber portion side opening of the communication passage 30. A fuel injector 34 is connected to a portion, on the chamber portion side, of the communication passage 30 via a connecting passage 33. The connecting passage 33 extends obliquely rearwardly from the portion, on the chamber portion side, of the communication passage 30.

Referring to FIG. 2, the rotary valve 40 has a portion forming a second control valve 42 and a portion forming a first control valve 41, which are continuously disposed in this order from the front side in the rotational direction. The shape of the second control valve 42 is different from that of the first control valve 41. The second control valve 42 controls the injection of an air-fuel mixture in the direction from the chamber portion 20 to the combustion chamber 13. The first control valve 41 controls the flow of a high compression gas in the direction from the combustion chamber 13 to the chamber portion 20.

The switching from the flow of an air-fuel mixture to the flow of a high compression gas by the rotary valve 40 is dependent on a balancing relationship between a pressure in the combustion chamber 13 and a pressure in the chamber portion 20 because the communication passage 30 is taken as the common communication passage. To be more specific, when the pressure in the combustion chamber 13 becomes higher than the pressure in the chamber portion 20, the flow in the communication passage 30 is switched from the flow of the air-fuel mixture into the flow of the high compression gas. At approximately this time, the flow control of the air-fuel mixture by the second control valve 42 is shifted to the flow control of the high compression gas by the first control valve 41.

An air-fuel mixture is formed as follows: namely, fuel is injected from the fuel injector 34 onto an inner wall surface, facing to the fuel injector 34, of the chamber portion side passage portion of the communication passage 30. The fuel is injected before the second control valve 42 opens the communication passage 30. When the second control valve 42 opens the communication passage 30, a high compression gas charged in the chamber portion 20 flows from the chamber portion side opening 32 of the communication passage 30, to be mixed with the standby fuel. The air-fuel mixture is then press-fed by the high compression gas in the chamber portion 20, to be injected from the cylinder side opening 31 of the communication passage 30 into the combustion chamber 13. Thereafter, at a point of time when the rotation of the rotary valve 40 advances and the first control valve 41 opens the communication passage 30, a high compression gas is charged from the combustion chamber 13 into the chamber portion 20, to be used for the next press-feeding of fuel.

Referring to FIG. 2, a portion formed into a crescent shape in cross-section, designated by reference numeral 35, is a fuel sump recess provided on the cylinder block 3 side at a boundary between-the inner wall of the communication 30 and the outer peripheral surface of the rotary valve 40. Fuel, which has been injected onto the inner wall of the chamber portion side passage portion of the communication passage 30 and reached the second control valve 42 before the second control valve 42 is opened, is captured in the recess 35 until the second control valve 42 is opened.

Referring to FIGS. 2 and 3, reference numeral 50 designates a lubricating oil supply hole formed in a portion, on the communication passage side, of the cylinder block, and 51 is a cylinder side opening of the lubricating oil supply hole 50. An oil pump (not shown) is connected to an outer opening 52 at the other end of the lubricating oil supply hole 50. In the embodiment shown in FIG. 2, the cylinder side opening 51 of the lubricating oil supply hole 50 is located at a circumferential position directly under the cylinder side opening 31 of the communication passage 30, and is also located at a vertical position equal to a vertical position at which a bottom surface 60 of a lower piston ring groove formed in the piston 6 is located when the piston 6 is moved down to the bottom dead center. From the practical viewpoint, however, the cylinder side opening 51 of the lubricating oil supply hole 50 may be located at a circumferential position in the same direction as the direction in which the cylinder side opening 31 of the communication passage 30 is located, as seen from the center axial line of the cylinder 5, and also be located at a vertical position lower than the lower edge of the cylinder side opening 31 of the communication passage 30 and higher than a position at which the bottom surface 60 of the lower piston ring groove formed in the piston 6 is located when the piston 6 is moved down to the bottom dead center. Since the lubricating oil supply hole 50 must be located without interference with the scavenging passage 21, the outer opening 52 of the lubricating oil supply hole 50 is provided in one side portion of the cylinder block 3 as shown in FIG. 3.

Referring to FIGS. 2 and 3, reference numeral 55 designates each of exhaust passage side lubricating oil supply holes provided on both sides of the exhaust passage 16. Reference numeral 56 is a cylinder side opening thereof and reference numeral 57 is an outer opening thereof to which an oil pump is connected. The vertical position of the cylinder side opening 56 of each exhaust passage side lubricating oil supply hole 55 is set to be the same as that of the cylinder side opening 51 of the communication passage side lubricating oil supply hole 50. The lubricating oil supply holes 55 are provided as needed, and therefore, they may be omitted.

Figure 4:
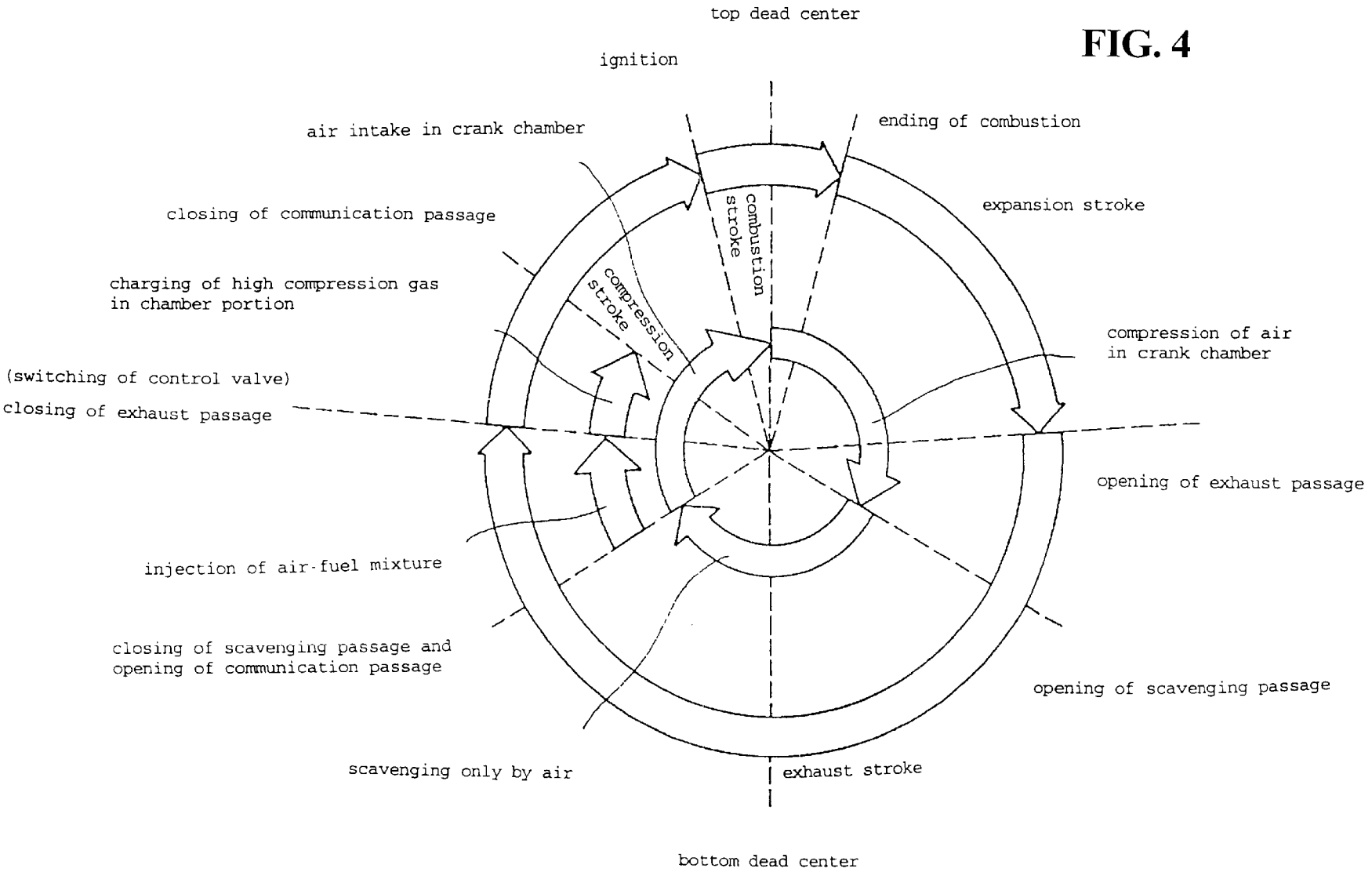
FIG. 4 is a diagram illustrating an operational cycle of the internal combustion engine shown in FIG. 1.

The two-cycle internal combustion engine 1 configured as described above is operated in accordance with an operational cycle shown in FIG. 4. As the crankshaft 8 is rotated counterclockwise in FIG. 1 by a starter motor (not shown), the piston 6 is moved up in the cylinder 5. At a point of time of about 580 past the bottom dead center, the air supply openings 15 and 22 are closed with the upwardly moving piston 6, to stop the scavenging by the flow-in of air through the scavenging passages 14 and 21, and nearly from this point of time, the second control valve 42 opens the communication passage 30 to inject an air-fuel mixture from the opening 31 into the combustion chamber 13, thereby scavenging the residual burnt gas, and at the same time, air is sucked from the intake passages 10 and 11 into the crank chamber 9 via the reed valve 12 by expansion of the crank chamber 9 along with the upward movement of the piston 6.

At a point of time of 90° before the top dead center, the exhaust opening 17 is closed with the piston 6, so that the operational cycle enters a compression stroke. Nearly at this point of time, the control valve is switched from the second control valve 42 into the first control valve 41, whereby the supply of the airfuel mixture in the combustion chamber 13 is ended and a high compression gas in the combustion chamber 13 is charged into the chamber portion 20 via the communication passage 30.

At a point of time of 75° before the top dead center, the first control valve 41 is closed to close the communication passage 30, and further, the opening 31 of the communication passage 30 is closed with the piston 6, to thereby end the charging of the high compression gas into the chamber portion 20.

The combustion chamber 13 is further compressed, and at a specific timing before the top dead center, the ignition plug 19 is ignited. Meanwhile, the crank chamber 9 is continued to be expanded by the upward movement of the piston 6, to continue air suction until the piston 6 reaches the top dead center.

After the piston 6 reaches the top dead center, the air-fuel mixture in the combustion chamber 13 is burnt to be expanded, and also the crank chamber 9 is compressed by downward movement of the piston 6, to compress the air in the crank chamber 9.

At a point of time of 90° past the top dead center, the exhaust opening 17 is opened, whereby the burnt gas is discharged from the exhaust passage 16.

At a point of time of about 122° past the top dead center, the scavenging openings 15 and 22 are opened from the downwardly moving piston 6, whereby the compressed air (containing no fuel) in the crank chamber 9 flows in the combustion chamber 13 via the scavenging passages 14 and 21 for supplying air, to push the burnt gas in the combustion chamber 13 toward the exhaust opening 17, thereby performing the scavenging only by air, and at the same time, fuel is injected from the fuel injector 34 onto the inner wall surface of the communication passage 30.

At a point of time of about 580 past the bottom dead center, the scavenging by the flow-in of air from the scavenging passages 14 and 21 is stopped, and the second control valves 42 opens the communication passage 30, to inject the air-fuel mixture into the combustion chamber 13, thereby scavenging the residual burnt gas. At the same time, air is sucked into the crank chamber 9 via the intake passages 10 and 11.

With respect to lubrication of the above-described two-cycle internal combustion engine, particularly, a portion, on the communication passage 30 side, of the piston 6, according to the present invention, the cylinder side opening 51 of the lubricating oil supply hole 50 is located directly under the cylinder side opening 31 of the communication passage 30, that is, located in the same direction as the direction in which the cylinder side opening 31 of the communication passage 30 is located, as seen from the center axial line of the cylinder 5, and is also located under the lower edge of the opening 31 of the communication passage 30. With this configuration, there can be obtained the following advantage: namely, when an outer peripheral portion of the piston 6 faces to the opening 31 of the communication passage 30, lubricating oil adhering thereon is carried away by gasoline; however, at the next instant, that is, when the piston 6 is moved downwardly therefrom, the outer peripheral portion of the piston 6 faces to the opening 51 of the lubricating oil supply hole 50 located directly under the opening 31 of the communication passage 30, whereby lubricating oil is newly supplied thereto and is then moved up by the upward movement of the piston 6, to be also used for lubricating a portion of the inner wall of the cylinder 5 from which lubricating oil has been washed away by gasoline. In this way, according to the present invention, even if lubricating oil is washed away by gasoline, lubricating oil can be immediately, newly supplied, so that it is possible to eliminate any deficiency in lubricating oil.

According to another configuration of the present invention, the opening 51 of the lubricating oil supply hole 50 is provided between the lower edge of the opening 31 of the communication passage 30 and a position at which the piston ring of the piston 6 is located when the piston 6 is moved down to the bottom dead center. Consequently, when the piston ring passes through the opening 51 of the lubricating oil supply hole 50, lubricating oil can be supplied to the piston ring itself from which lubricating oil has been carried away by gasoline. As a result, it is possible to effectively lubricate the sliding surface of the sliding portion between the cylinder and the piston.

The present invention also exhibits an additional advantage that since the opening 51 of the lubricating oil supply hole 50 is separated downwardly from the combustion chamber 13, a period of time in which the opening 51 of the lubricating oil supply hole 50 is exposed to a combustion gas atmosphere in the downward stroke of the piston 6 can be reduced or the exposure of the opening 51 can be eliminated, with a result that it is possible to reduce the influence of heat and/or pressure in the combustion chamber 13 exerted on the lubricating oil supply hole 50.

Figure 5:
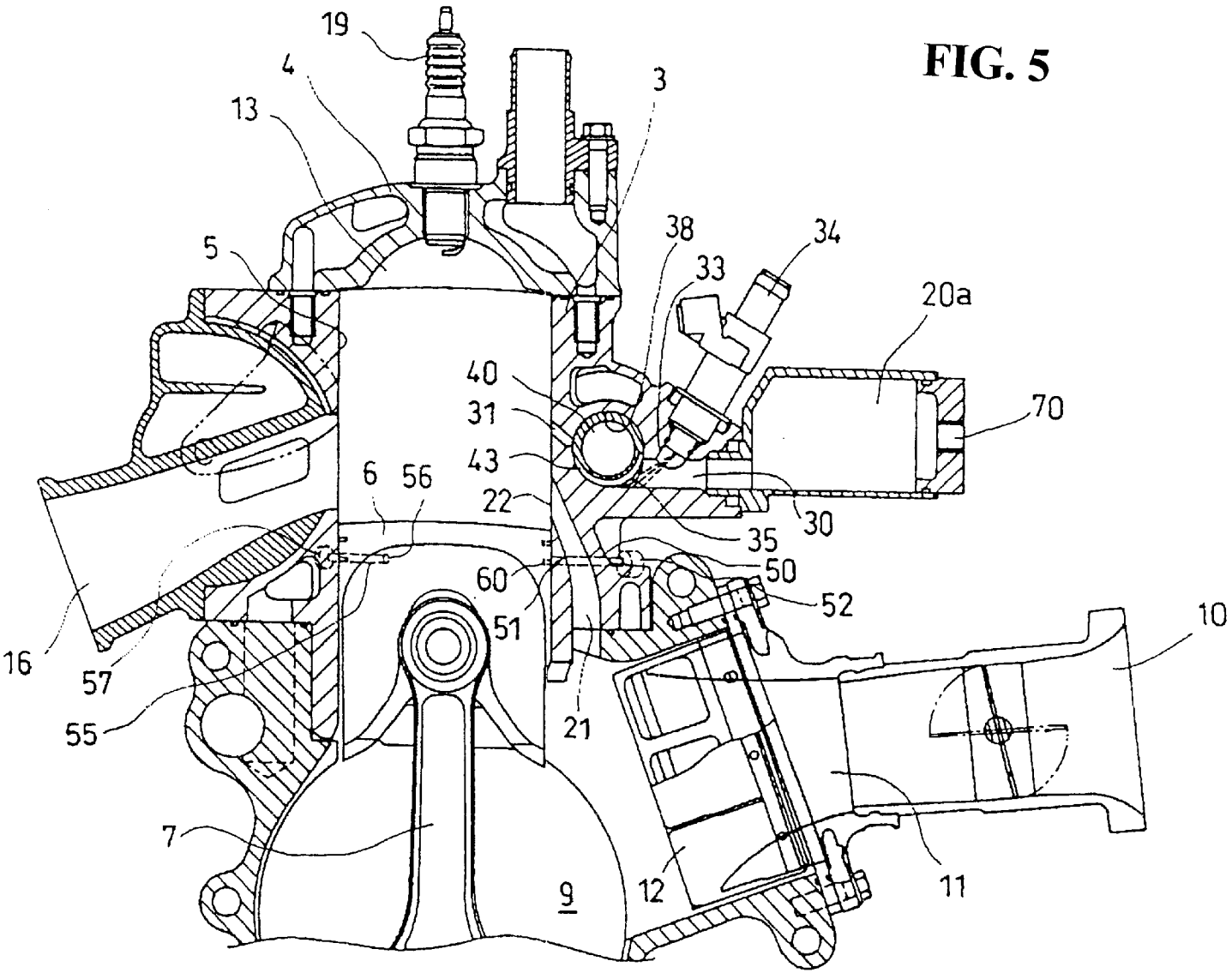
FIG. 5 is a cross sectional side view of a two-cycle internal combustion engine, according to an alternative embodiment of the present invention.
Figure 6:
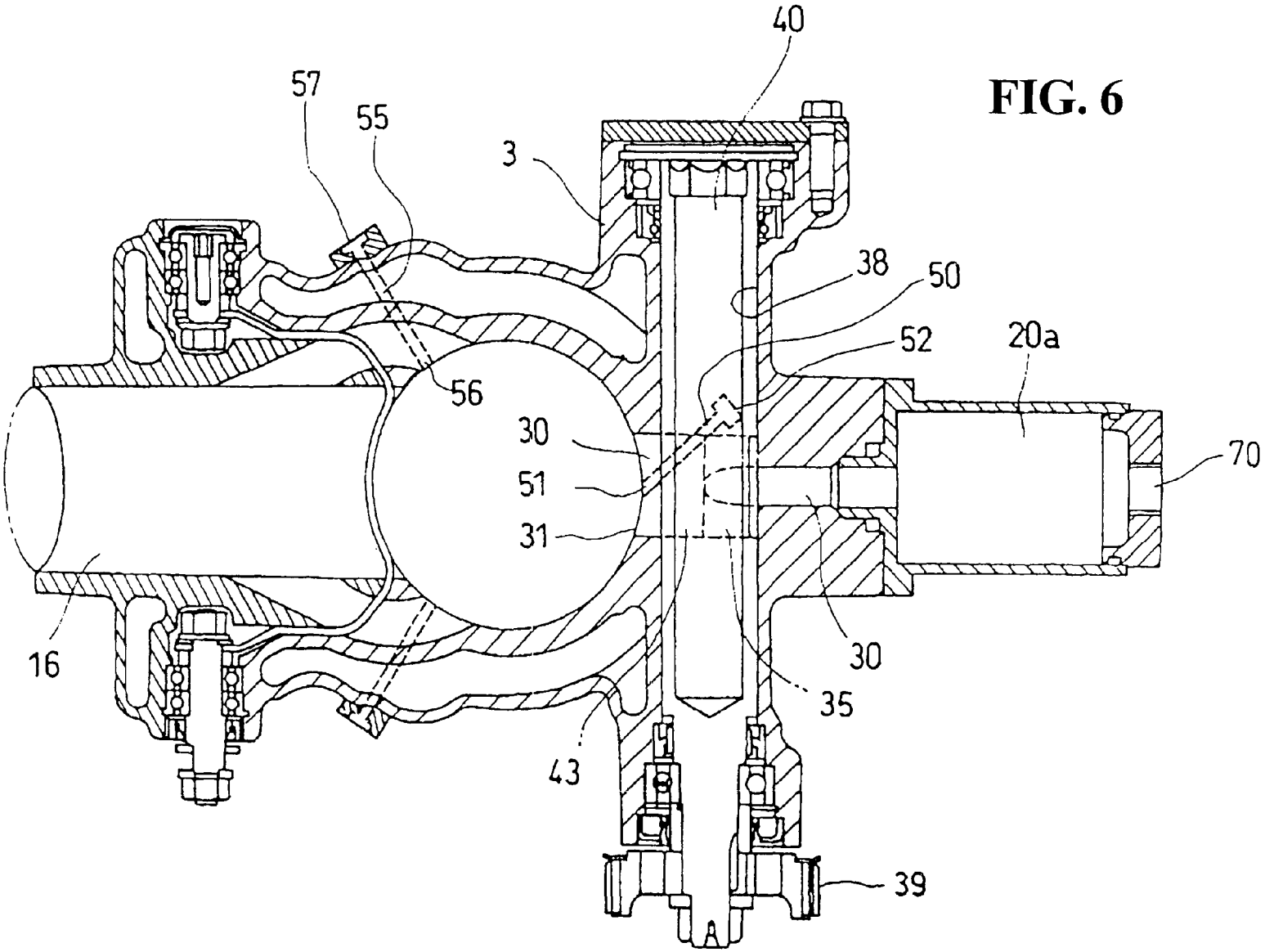
FIG. 6 is a cross sectional overhead view of the internal combustion engine shown in FIG. 5.
Figure 7:
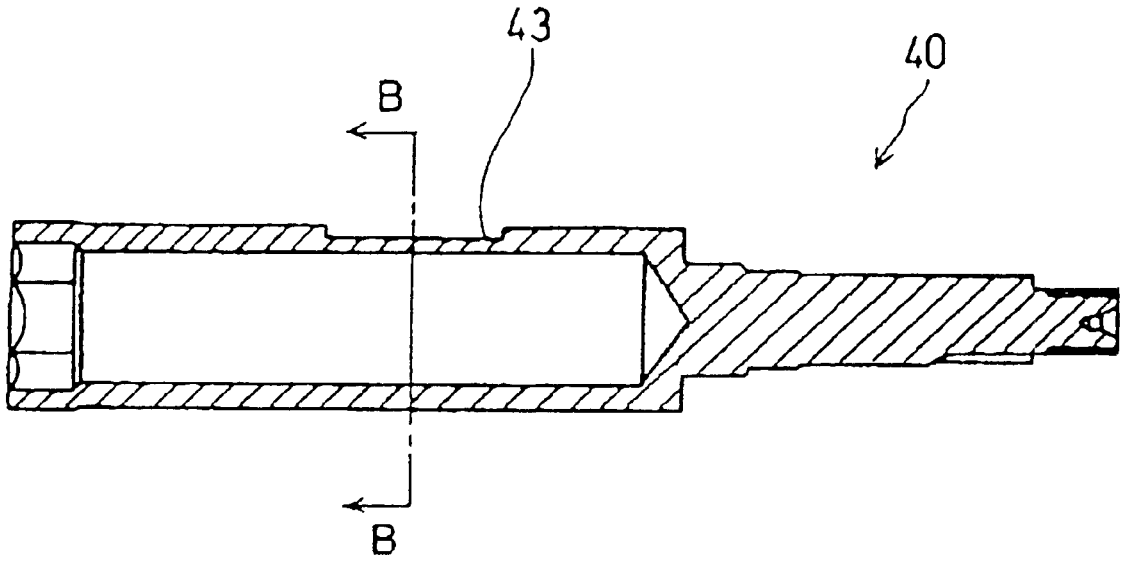
FIGS. 7(*a*) and 7(*b*) are cross sectional views showing a rotary valve used in the internal combustion engine shown in FIG. 5, wherein FIG. 7(*a*) is a longitudinal sectional view of the rotary valve, and FIG. 7(*b*) is a sectional view taken on line B—B of FIG. 7(*a*)
Figure 7:
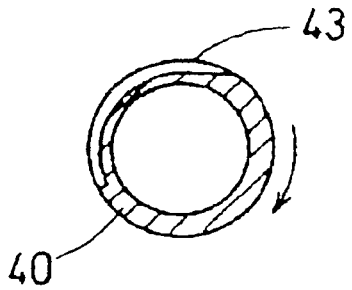

A second embodiment of the present invention will be described below. FIG. 5 is a cross sectional side view of an important portion of a spark ignition type two-cycle internal combustion engine, according to an alternative embodiment of the present invention. FIG. 6 is a cross sectional overhead view taken on a cross-sectional plane passing through a rotary valve shown in FIG. 5. FIGS. 7(*a*) and 7(*b*) are views showing the rotary valve according to this embodiment.

In the first embodiment, a high compression gas is supplied from the combustion chamber into the chamber portion via the first control valve. However, in this embodiment, the first control valve is omitted and a high compression gas is supplied into the chamber portion by a pump (not shown) separately provided. Accordingly, in this embodiment, only the second control valve is left as the control valve, and therefore, the adjective "second" is omitted and the valve having a function of the second control valve is referred to simply as "control valve".

Referring to FIGS. 5 and 6, a chamber portion 20*a* is provided in a portion, offset to the rear side of the vehicular body, of a cylinder block 3. Reference numeral 70 designates a pump connection port provided in one end surface of the chamber portion 20*a*. A pump (not shown) for injecting a high compression gas is connected to the pump connection port. A communication passage 30 for communicating the chamber portion 20*a* to a cylinder bore 5 is provided in the cylinder block 3.

A valve housing hole 38 is provided in such a manner as to cross a mid portion of the communication passage 30. A rotary valve 40 is rotatably fitted in the valve housing hole 38. The rotary valve 40 is rotated via a pulley 39 mounted to an end portion of the rotary valve 40 by a transmission mechanism (not shown).

FIGS. 7(*a*) and 7(*b*) show the rotary valve 40. As shown in these figures, a control valve 43 is formed as a cutout having a specific length in the peripheral direction and also having a specific depth. The control valve 43 has no portion equivalent to the first control valve 41 described in the first embodiment (see FIG. 2) and is configured only by a portion equivalent to the second control valve 42 in the first embodiment. Like the first embodiment, the edges of the cutout functioning as the control valve 43 are formed so as not to be stepped for allowing an air-fuel mixture to be linearly, smoothly sprayed. Fuel is injected from a fuel injector 34 (see FIG. 5) immediately before the control valve 43 opens the communication passage.

Referring to FIGS. 5 and 6, reference numeral 50 designates a lubricating oil supply hole provided in a portion, on the communication passage side, of the cylinder block 3, and 51 is a cylinder side opening of the lubricating oil supply hole 50. An oil pump (not shown) is connected to an outer opening 52 at the other end of the lubricating oil supply hole 50. The cylinder side opening 51 of the lubricating oil supply hole 50 may be located at a circumferential position directly under a cylinder side opening 31 of the communication passage 30 and also located at a vertical position lower than the lower edge of the cylinder side opening 31 of the communication passage 30 and higher than a position at which a bottom surface 60 of a lower piston ring groove formed in a piston 6 is located when the piston 6 is moved down to the bottom dead center. Since the lubricating oil supply hole 50 is required to be provided without interference with a scavenging passage 21 for supplying air, the outer opening 52 of the lubricating oil supply hole 50 is, as illustrated in FIG. 6, provided in one side portion of the cylinder block 3.

In FIGS. 5 and 6, reference numeral 55 designates each of two exhaust passage side lubricating oil supply holes provided on both sides of an exhaust passage, and 56 is a cylinder side opening thereof and 57 is an outer opening thereof to which an oil pump is connected. The vertical position of the cylinder side opening 56 of each of the exhaust passage side lubricating oil supply holes 55 is set to be equal to that of the cylinder side opening 51 of the communication passage side lubricating oil supply hole 50. The lubricating oil supply holes 55 are provided as needed, and therefore, they may be omitted. In addition, the positions and layout conditions of the lubricating oil supply holes in this embodiment are the same as those in the first embodiment.

Figure 8:
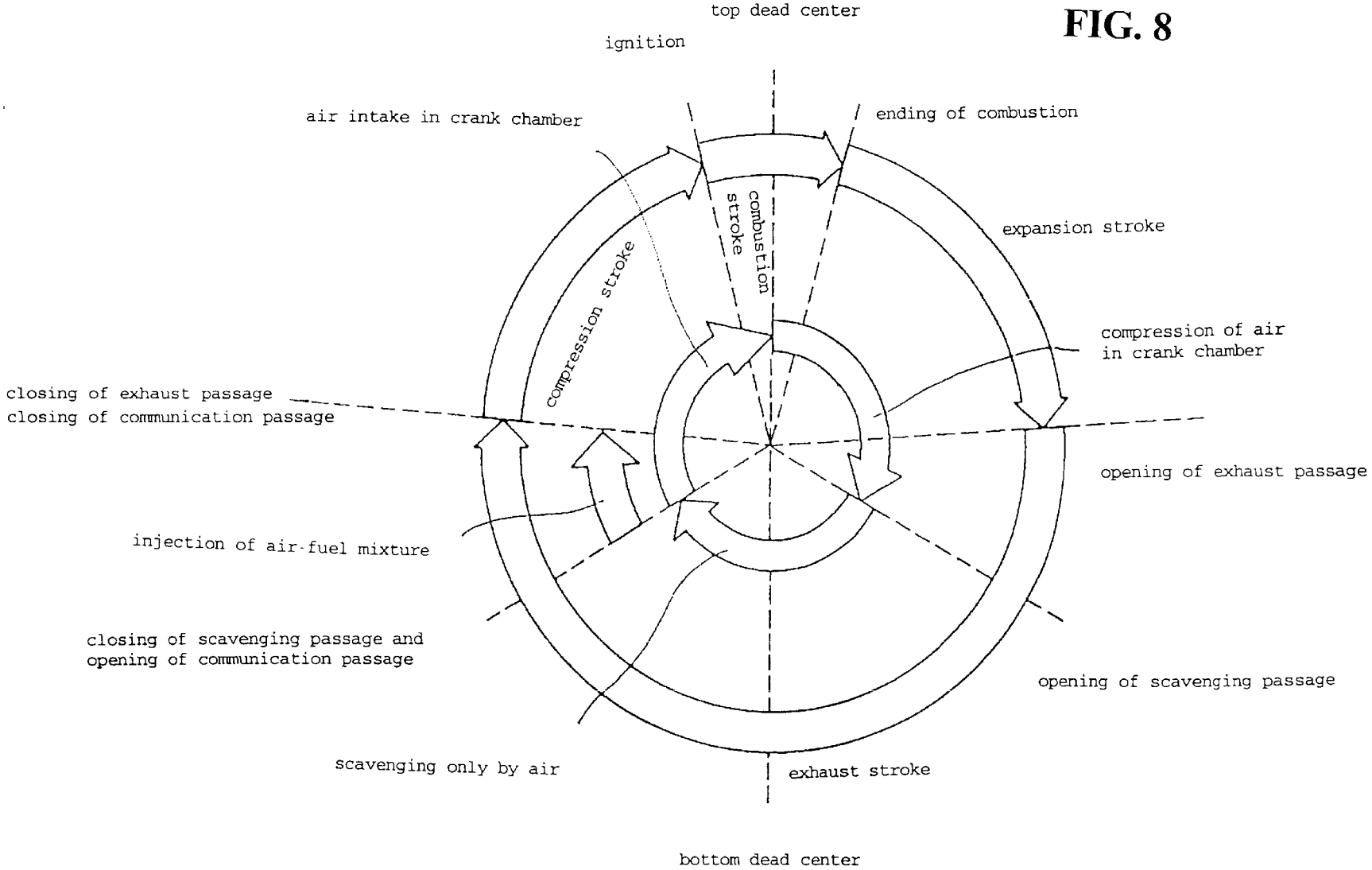
FIG. 8 is a diagram illustrating an operational cycle of the internal combustion engine shown in FIG. 5.
Figure 9:
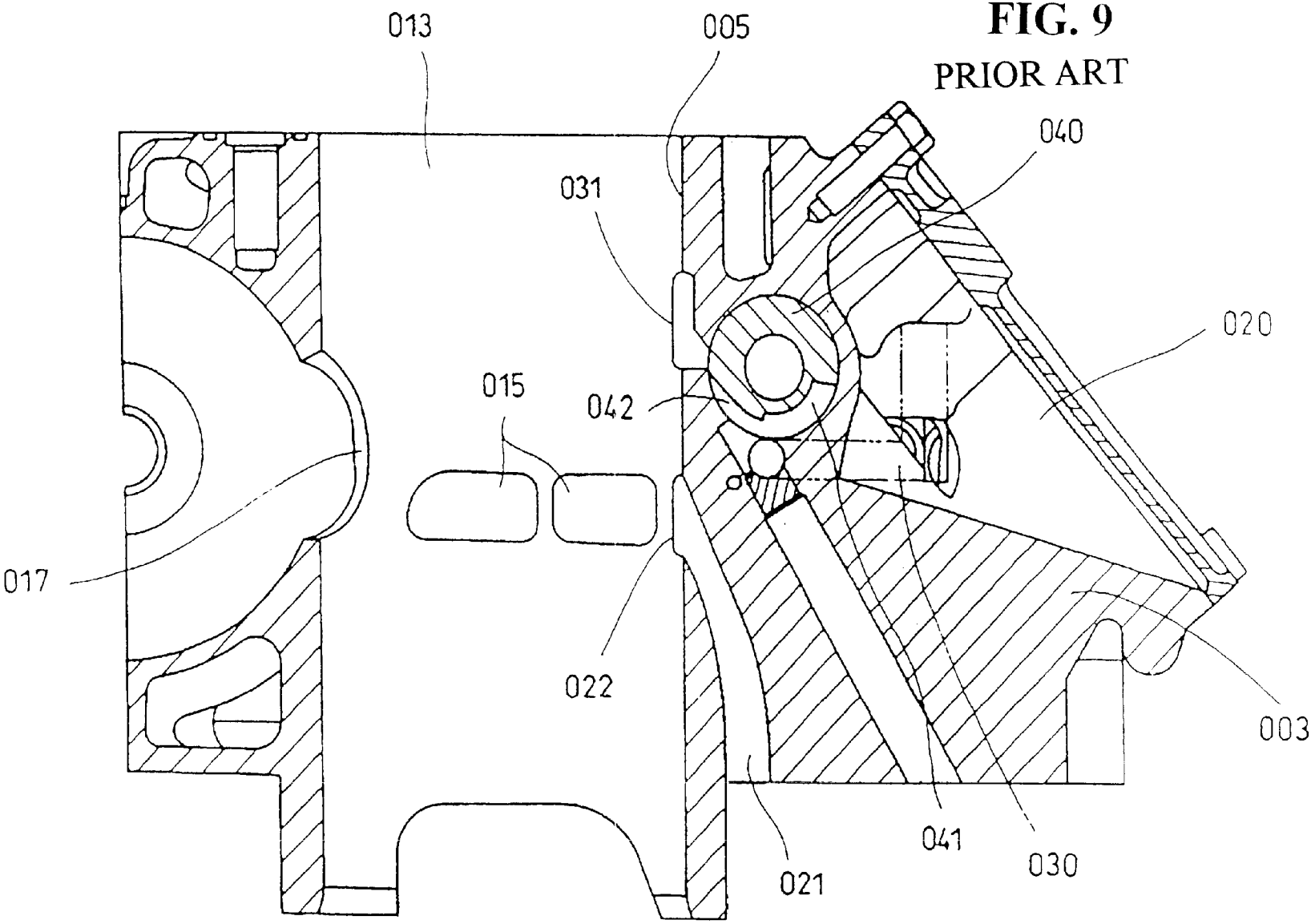
FIG. 9 PRIOR ART
FIG. 9 is a close-up cross sectional side view of an important portion of an internal combustion engine, according to the prior art.
Figure 10:
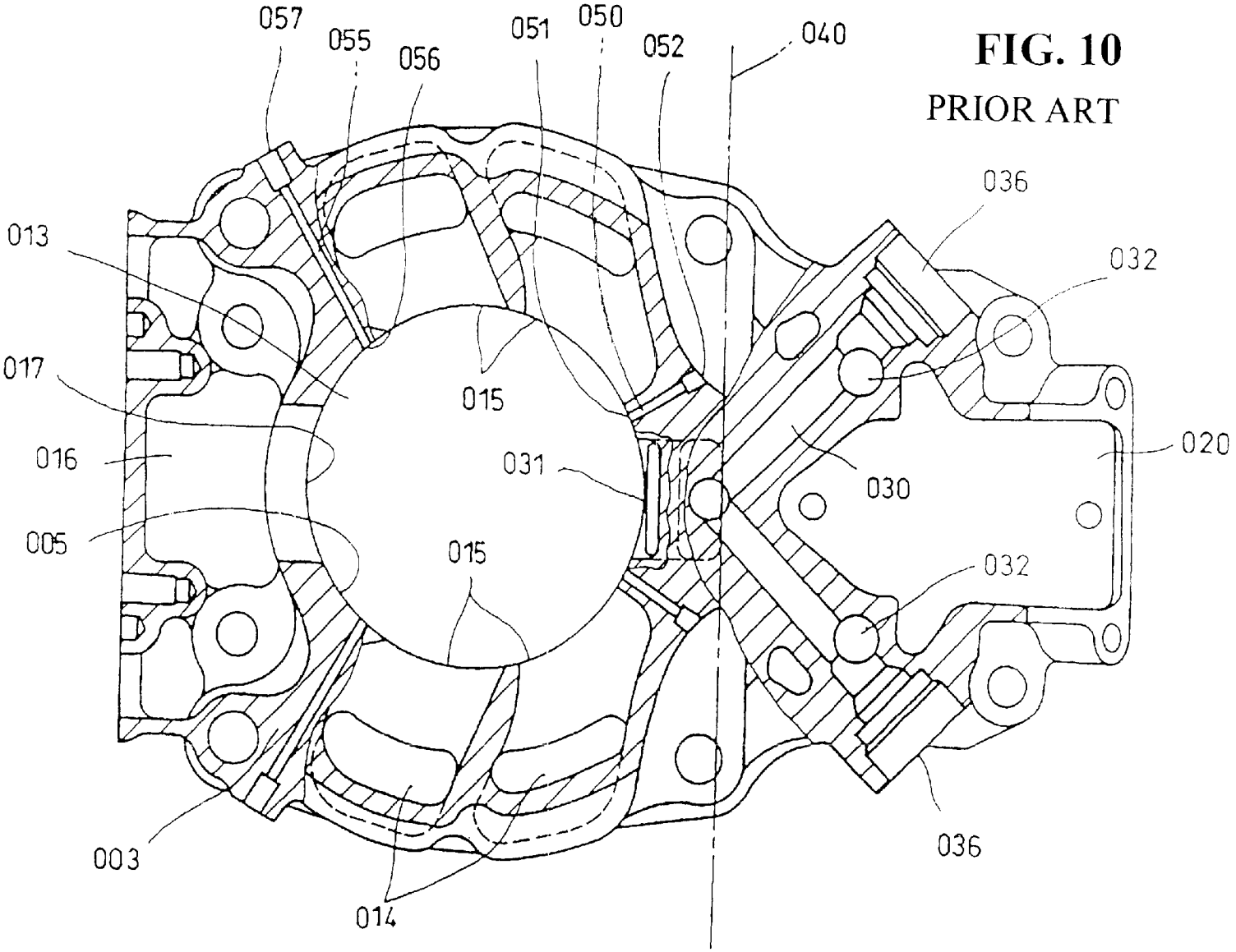
FIG. 10 PRIOR ART
FIG. 10 is a cross sectional overhead view of the important portion of the internal combustion engine of FIG. 9.

FIG. 8 is a diagram illustrating an operational cycle of this embodiment. The operational cycle of this embodiment is different from the operational cycle of the first embodiment in that a high compression gas is charged in the chamber portion not from the combustion chamber but from another gas source by means of a pump (not shown). Accordingly, in this embodiment, the process "Charging of High Compression Gas in Chamber Portion Via First Communication Passage" shown by the arrow in FIG. 4 is omitted. The control valve 43 opens the communication passage 30 nearly at a point of time when the scavenging opening is closed, and closes the communication passage 30 at a mid point in the compression stroke. The other processes are carried out in the same manner as those described in the first embodiment.

The configurations and functions of parts other than those described above are the same as those of the corresponding parts described in the first embodiment, and therefore, the parts other than those described above are designated in the figures by the same reference numerals of the corresponding parts in the first embodiment and the detailed description thereof is omitted.

According to the present invention, since the cylinder side opening of the lubricating oil supply hole is located at a vertical position lower than the lower edge of the cylinder side opening of the communication passage and higher than a position at which the bottom surface of the lower piston ring groove formed in the piston is located when the piston is moved down to the bottom dead center, the piston ring passes through the lubricating oil supply hole in the upward or downward stroke of the piston, whereby lubricating oil can be immediately supplied, by movement of the piston, to a portion from which lubricating oil has been carried away by gasoline. As a result, it is possible to enhance the effect of keeping the lubricating performance.

Since lubricating oil can be supplied to the piston ring itself from which lubricating oil has been carried or washed away by gasoline, it is possible to effectively lubricate the sliding surface of the piston ring.

Since the lubricating oil supply hole can be provided at a lower position separated downwardly from the combustion chamber, it is possible to reduce the influence of heat and/or pressure in the combustion chamber exerted on the lubricating oil supply hole, and hence to enhance the effect of keeping the lubricating performance.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. An internal combustion engine comprising:

a cylinder block having a cylinder formed therein;

a piston reciprocally moveable within said cylinder;

a combustion chamber formed at one end of said cylinder;

a chamber portion;

a communication passage having a first end opening to said cylinder and a second end opening to said chamber portion, said first end opening to said cylinder along a width;

a control valve provided in said communication passage for controlling an opening and closing of said communication passage;

a scavenging passage opening to said cylinder at a position below said first end of said communication passage; and a lubricating oil supply for providing oil to said cylinder, said lubricating oil supply feeding oil to a first hole provided in a wall of said cylinder, wherein said first hole is one hole positioned below said first end of said communication passage and below said opening of said scavenging passage into said cylinder, when taken in a reciprocal travel direction of said piston, and wherein said first hole is located below and within said width of said first end of communication passage.

2. The internal combustion engine according to claim 1, wherein said first hole is positioned in line with a center of said first end of said communication passage, such that said first end of said communication passage is located between said first hole and said combustion chamber.

3. The internal combustion engine according to claim 2, further comprising:

a first ring encircling said piston, wherein said first hole is positioned between said first end of said communication passage and said first ring, when said piston is at a lowest position in its reciprocal travel.

4. The internal combustion engine according to claim 3, further comprising:

a second ring encircling said piston, wherein said first ring is a positioned lower on said piston than said second ring, and wherein said first hole is positioned between a lower edge of said first end of said communication passage and a lower edge of said first ring, when said piston is at a lowest position in its reciprocal travel.

5. The internal combustion engine according to claim 1, further comprising:

an exhaust port formed in said wall of said cylinder.

6. The internal combustion engine according to claim 5, wherein said lubricating oil supply also feeds oil to a second hole and a third hole provided in said wall of said cylinder, wherein said second hole and said third hole are positioned on opposite sides of said exhaust port.

7. The internal combustion engine according to claim 6, wherein said first hole, said second hole and said third hole are positioned at a same height, taken in a reciprocal travel direction of said piston.

8. The internal combustion engine according to claim 1, wherein said chamber portion receives a high compression gas and discharges an air-fuel mixture into said cylinder for combustion in said combustion chamber.

9. The internal combustion engine according to claim 8, wherein said chamber portion receives the high compression gas via said communication passage.

10. The internal combustion engine according to claim 9, wherein said control valve includes a first valve portion for controlling passage of the high compression gas into the chamber portion.

11. The internal combustion engine according to claim 10, wherein said control valve includes a second valve portion for controlling the passage of the air-fuel mixture into said cylinder.

12. The internal combustion engine according to claim 8, wherein said chamber portion receives the high compression gas via a pump supplying the high compression gas to an inlet of said chamber portion.

13. The internal combustion engine according to claim 11, wherein said first end of said communication passage opens in an upper portion of said cylinder.

14. The internal combustion engine according to claim 13, wherein said first end of said communication passage forms a constituent component of said combustion chamber.

15. The engine according to claim 1, wherein said internal combustion engine is a two-cycle engine.

16. The internal combustion engine according to claim 1, wherein said control valve is a rotary valve.

17. The internal combustion engine according to claim 12, wherein said control valve controls the passage of the air-fuel mixture into said cylinder.

18. An internal combustion engine comprising:

a cylinder block having a cylinder formed therein;

a piston reciprocally moveable within said cylinder;

a combustion chamber formed at one end of said cylinder;

a chamber portion;

a communication passage having a first end opening to said cylinder and a second end opening to said chamber portion, said first end opening to said cylinder along a width, wherein said chamber portion receives a high compression gas and discharges an air-fuel mixture into said cylinder for combustion in said combustion chamber;

a scavenging passage opening to said cylinder at a position below said first end of said communication passage; and a lubricating oil supply for providing oil to said cylinder, said lubricating oil supply feeding oil to a first hole provided in a wall of said cylinder, wherein said first hole is one hole positioned below said first end of said communication passage and below said opening of said scavenging passage into said cylinder, when taken in a reciprocal travel direction of said piston, and wherein said first hole is located below and within said width of said first end of communication passage.

19. The internal combustion engine according to claim 18, wherein said first hole is positioned in line with a center of said first end of said communication passage, such that said first end of said communication passage is located between said first hole and said combustion chamber.

20. The internal combustion engine according to claim 19, further comprising:

a ring encircling said piston, wherein said first hole is positioned between a lower edge of said first end of said communication passage and a lower edge of said ring, when said piston is at a lowest position in its reciprocal travel.

21. The internal combustion engine according to claim 18, further comprising:

an exhaust port formed in said wall of said cylinder, wherein said lubricating oil supply also feeds oil to a second hole and a third hole provided in said wall of said cylinder, wherein said second hole and said third hole are positioned on opposite sides of said exhaust port, and wherein said first hole, said second hole and said third hole are positioned at a same height, taken in a reciprocal travel direction of said piston.

* * * * *